US005899048A

United States Patent [19]

Havens et al.

[11] Patent Number: 5,899,048

[45] **Date of Patent: * May 4, 1999**

[54] SHRINK TUNNEL

[75] Inventors: Marvin Russell Havens, Greer; George Dean Wofford, Duncan, both of S.C.

[73] Assignee: W.R. Grace & Co.-Conn., Duncan, S.C.

[ * ] Notice: This patent is subject to a terminal disclaimer.

[21] Appl. No.: 08/125,631

[22] Filed: Sep. 23, 1993

[51] Int. Cl.[6] ..... B65B 53/02

[52] U.S. Cl. ..... 53/442; 53/557

[58] Field of Search ..... 53/442, 557; 34/132, 34/134, 137; 432/118

[56] References Cited

U.S. PATENT DOCUMENTS

| | | | |
|---|---|---|---|
| 929,167 | 7/1909 | Poths | 432/118 |
| 3,127,273 | 3/1964 | Monahan | 53/442 |
| 3,156,812 | 11/1964 | Forman et al. | 53/557 X |
| 3,399,506 | 9/1968 | Howe | 53/442 |
| 3,524,296 | 8/1970 | Piazze | 53/442 X |
| 3,556,498 | 1/1971 | Sheahan | 432/118 X |
| 3,778,964 | 12/1973 | Rowland . | |
| 3,869,844 | 3/1975 | Edouard . | |
| 4,181,495 | 1/1980 | Bernt | 432/118 |
| 4,204,379 | 5/1980 | Mugnai et al. . | |
| 4,272,945 | 6/1981 | Obrist | 53/557 |
| 4,535,550 | 8/1985 | Walter | 34/134 X |
| 4,597,193 | 7/1986 | Kallfass . | |
| 5,116,363 | 5/1992 | Romweber et al. | 34/137 X |

FOREIGN PATENT DOCUMENTS

| | | | |
|---|---|---|---|
| 2352277 | 5/1974 | Germany | 53/557 |
| 3924871A1 | 2/1991 | Germany . | |
| 627018 | 10/1978 | U.S.S.R. | 53/557 |

*Primary Examiner*—Linda Johnson
*Attorney, Agent, or Firm*—Mark B. Quatt

[57] ABSTRACT

An apparatus for heat shrinking of a heat-shrinkable thermoplastic film that is used to package a product by passing the product packaged in the film through a rotatable shrink tunnel with a heated transfer medium passing through the tunnel to cause the shrinkage of the wrap material.

4 Claims, 3 Drawing Sheets

SHRINK TUNNEL

BACKGROUND OF THE INVENTION (1) Field of the Invention

This invention relates to a tunnel for treating articles packaged in heat shrinkable thermoplastic film. More particularly, this invention relates to a rotatable shrink tunnel in which the packaged article to be treated is fed through the tunnel.

(2) Description of the Prior Art

As the food industry moves toward more convenient products, improved packaging is desired. For example, many food products, especially meats, are packaged in heat shrinkable thermoplastic film. One effective use of heat shrinkable thermoplastic films is in processing facilities where meat is pre-packaged in bulk quantities. When a food product is packaged, even if a vacuum is drawn, there is excess film around the product and the packaged product is heated to shrink the film to conform tightly to the product. Controlling the temperature of the film shrinking is important because the temperature must be high enough to cause the thermoplastic film to shrink yet must not be so high as to adversely affect the food product.

Heated shrink tunnels are normally used for shrinking thermoplastic films. The products packaged in heat shrinkable thermoplastic film are conveyed into the shrink tunnel and subjected to a heat transfer medium such as heated air or heated water. The effect of heat transferred by the medium causes the film to shrink and conform tightly to the products in the package.

Shrink tunnels are generally either of the heated air-type or the heated water-type. A shrink tunnel of the heated air-type is disclosed in U.S. Pat. No. 4,204,379 to Mugnai, which discloses a closed circuit heat shrink tunnel using recirculated heated air blown around the packaged product at high speed as the heat transfer medium. The wrapped packages are individually placed in the shrinking chamber. Other heated air-type shrink tunnels gradually move the wrapped package through the shrink tunnel on a conveyor belt at a relatively low speed where hot air is passed over and around the article. One such device is shown in U.S. Pat. No. 3,778,964 to Rowland.

Air is sometimes used as the heat transfer medium because it is inexpensive and easier to handle in a packaging plant, but it does not transfer heat very well. Additionally, in order to impart the heat to the film, the air temperature must be relatively high bringing the temperature close to the distortion temperature of the film or to the temperature at which the food product will be adversely affected. Another disadvantage of the typical hot air shrink tunnels is that the heat in the air is quickly lost as the air moves across the package causing uneven shrinkage from one portion of the package to the other.

Because air is a relatively poor heat transfer medium, heated water-type shrink tunnels are sometimes used wherein heated water is the transfer medium. For example, a variety of heated water-type shrink tunnels are manufactured by the Cryovac Division of W. R. Grace. However, the use of hot water for this purpose, although being a good heat transfer medium, contributes to high overall energy consumption. Also, when a shrink tunnel is used to package meat in bulk sizes, say for example, in a slaughterhouse, heated water-type shrink tunnels tax the building cooling system. The temperature in the slaughterhouse where the meat is processed is kept at about 50° F. or colder. Water vapor can raise the temperature of the meat processing room above the desired temperature. Additionally, when heat shrinking using heated water as the transfer medium, the heated water is sprayed over the package leaving a tightly packaged product but a wet package which must be dried. These disadvantages are perceived by some as detriments to good packaging.

With the foregoing in mind, it is an object of the present invention to provide a heated shrink tunnel wherein a substantial portion of the heat required to shrink the film is imparted to the package by substantial contact of the surfaces of the package with the heated surfaces of the tunnel, thus helping to impart heat to the film causing it to shrink.

Another object of this invention is to provide a heated shrink tunnel wherein a substantial portion of the heat required to shrink the film is imparted by a heated gas passing evenly across all surfaces of the package, thus helping to impart heat to the film causing it to shrink.

Still another object of this invention is to provide a method for heat shrinking a package of a heat shrinkable thermoplastic film by imparting the heat required to shrink the film from the heat transfer medium and the heated surfaces of the shrink tunnel.

Yet another object of the present invention is to provide a shrink tunnel in an enclosed circulating system in which high gas flow rates may be used to avoid extremely high temperatures or alternatively shorten heating times.

An even further object of this invention is to provide a heated air-type shrink tunnel for heat shrinking an increased number of wrapped packages in a rotating, gravity-fed shrink tunnel.

Other objects, features and advantages will become apparent from the following description.

SUMMARY OF THE INVENTION

In accordance with the present invention, there is provided a shrink tunnel system having a rotatable tunnel for heat shrinking thermoplastic film around a package such as a food product using a hot gas as the heat transfer medium. The rotatable tunnel is preferably inclined to the horizontal with one end being an inlet at a higher elevation than its other end so that the package passes through the rotatable tunnel via gravity and the hot gas circulates through the tunnel in either direction. Preferably the transfer medium is heated air.

In one embodiment a rotatable tunnel is provided with raised protrusions on the interior surface of the tunnel of such sizes and shapes as to cause the wrapped package to tumble around and over itself for better physical and thermal contact with the circulating transfer medium and with the heated interior surfaces of the tunnel. The interior surfaces of the tunnel are preferably formed of a high heat capacity material. The tumbling action of the packaged product results in the faces of the packaged article having substantial contact with the heated interior surfaces of the tunnel whereby the thermoplastic film absorbs a significant amount of the heat needed for shrinkage. In addition, the heated transfer medium itself imparts significant heat to the faces of the package. To increase the thermal capacity of the heat transfer from the interior surfaces, the interior surfaces may include a resilient liner. The heated transfer medium reheats the interior surfaces of the tunnel as it passes through the tunnel.

In another embodiment, the body of the shrink tunnel is specifically shaped to make available to the faces of the package a large surface area of the interior of the tunnel for contact to impart heat. The shape and size of the packaged product may be irregular and will depend upon the particular product to be packaged. For example, it is envisioned that the interior shape of the tunnel may be different for shrinking film on a bulk meat product than for shrinking film on a poultry product. Thus, the interior shape of the tunnel may include oval, square, octangular or frustoconical, for example.

The rotatable tunnel is provided with inlet and return plenums for circulating the heated gas through the rotatable tunnel and across the faces of the packaged products. The rotatable shrink tunnel forms a closed recirculating system. Because the return gas is warmer than the ambient gas, less energy is needed to reheat the gas. Further, because the circulating system is enclosed, there is little heat loss outside the system. The rotatable tunnel allows shrinkage of successively wrapped packages to be quickly accomplished.

In a preferred operation, the package passes through an entrance on a conveyor, for example, to the inlet end of an inclined rotating tunnel. As the tunnel rotates, the package tumbles downwardly through the tunnel making contact on all surfaces with heated gas flowing through the rotating tunnel and the package makes physical contact with the heated interior surfaces of the tunnel. The package is evenly shrunk on all surfaces and exits the outlet end of the tunnel and passes through an exit way.

DESCRIPTION OF THE PREFERRED EMBODIMENTS

There is provided by the present invention a heat shrink system that is especially useful for heat shrinking packages of food products, especially meat or poultry, in flexible thermoplastic film.

Figures 3, 4, 5:
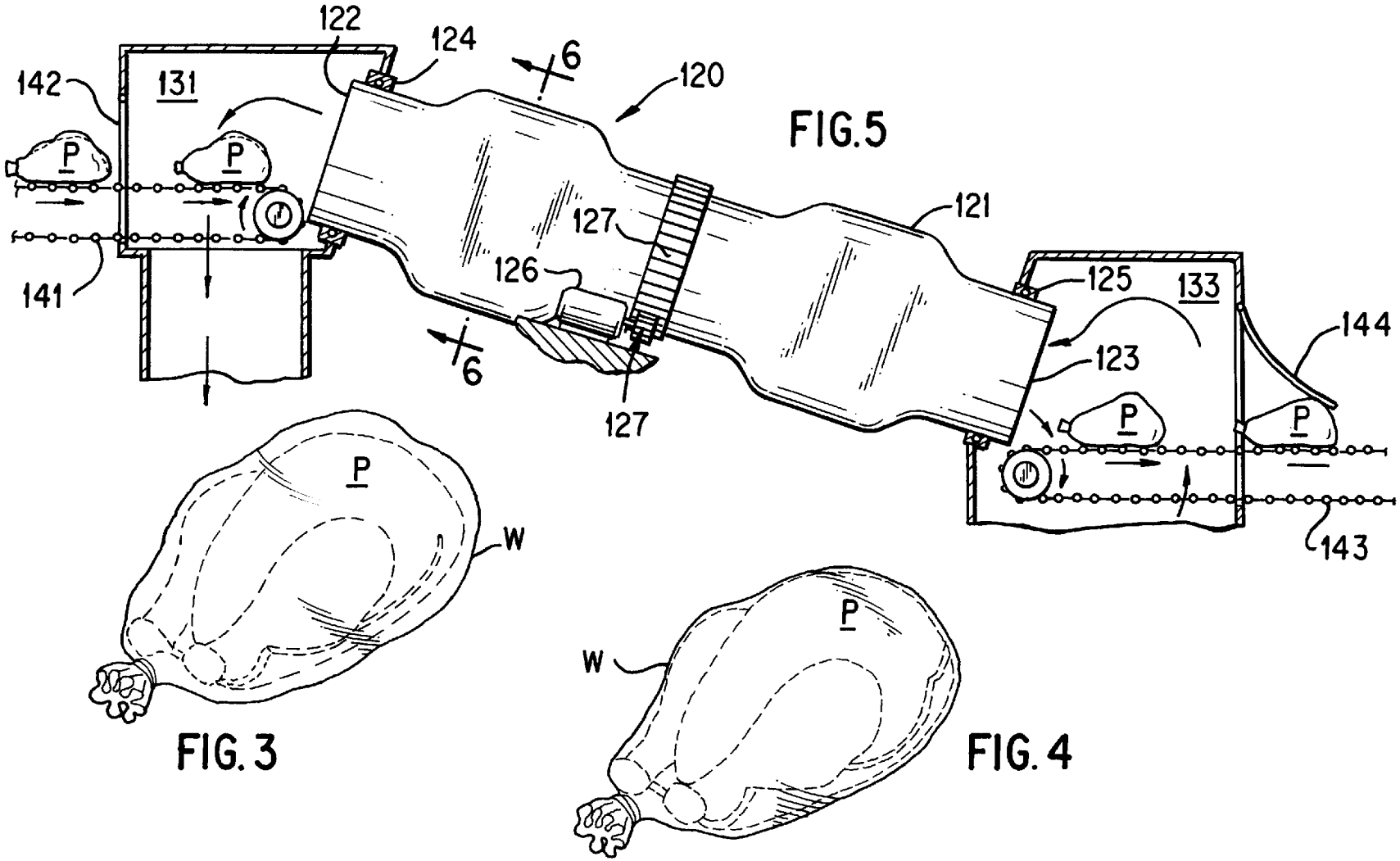
FIG. 3 illustrates a packaged food product wrapped in heat shrinkable thermoplastic film prior to entering the shrink tunnel.
FIG. 4 illustrates the packaged food product wrapped in heat shrinkable thermoplastic film after leaving the shrink tunnel.
FIG. 5 is a partial side elevation view of an embodiment of the shrink tunnel of the present invention.

Referring to the drawings, there is indicated in FIG. 3 a package containing a food product P which is wrapped in flexible thermoplastic heat shrinkable film. While many heat shrinkable films are available, the particular product being packaged goes a long way to determining which type of film will be used. For example, when the product is meat packaged in bulk, it is desirable to use a film having an oxygen barrier layer, such as polyvinylidene chloride. However, meat packaging is not limited to films having an oxygen barrier layer. On the other hand, when the product is poultry, it is desirable to use a polyolefin based film that does not confine poultry odors. Other heat shrinkable films include polyethylene films and the like. The film wraps around the top, sides and ends of the product and the ends are folded under the product and heat sealed in a prior operation. Alternatively, the food product can be placed inside a bag that is heat-sealed or clipped closed. Packages made in accordance with the present invention can optionally be partially or completely vacuumized before the shrink step. As shown in FIG. 3, the wrapped package P is a turkey placed in a bag made of thermoplastic film W. It should be understood that articles and products of various other sizes and shapes may be shrink wrapped using the system of this invention. Once the package passes through the shrinking tunnel, the thermoplastic film W shrinks tightly around the article, as shown in FIG. 4, forming almost a second skin. As shown in FIG. 3 and FIG. 4, it is sometimes desirable to include with the package an absorbent pad.

Figure 1:
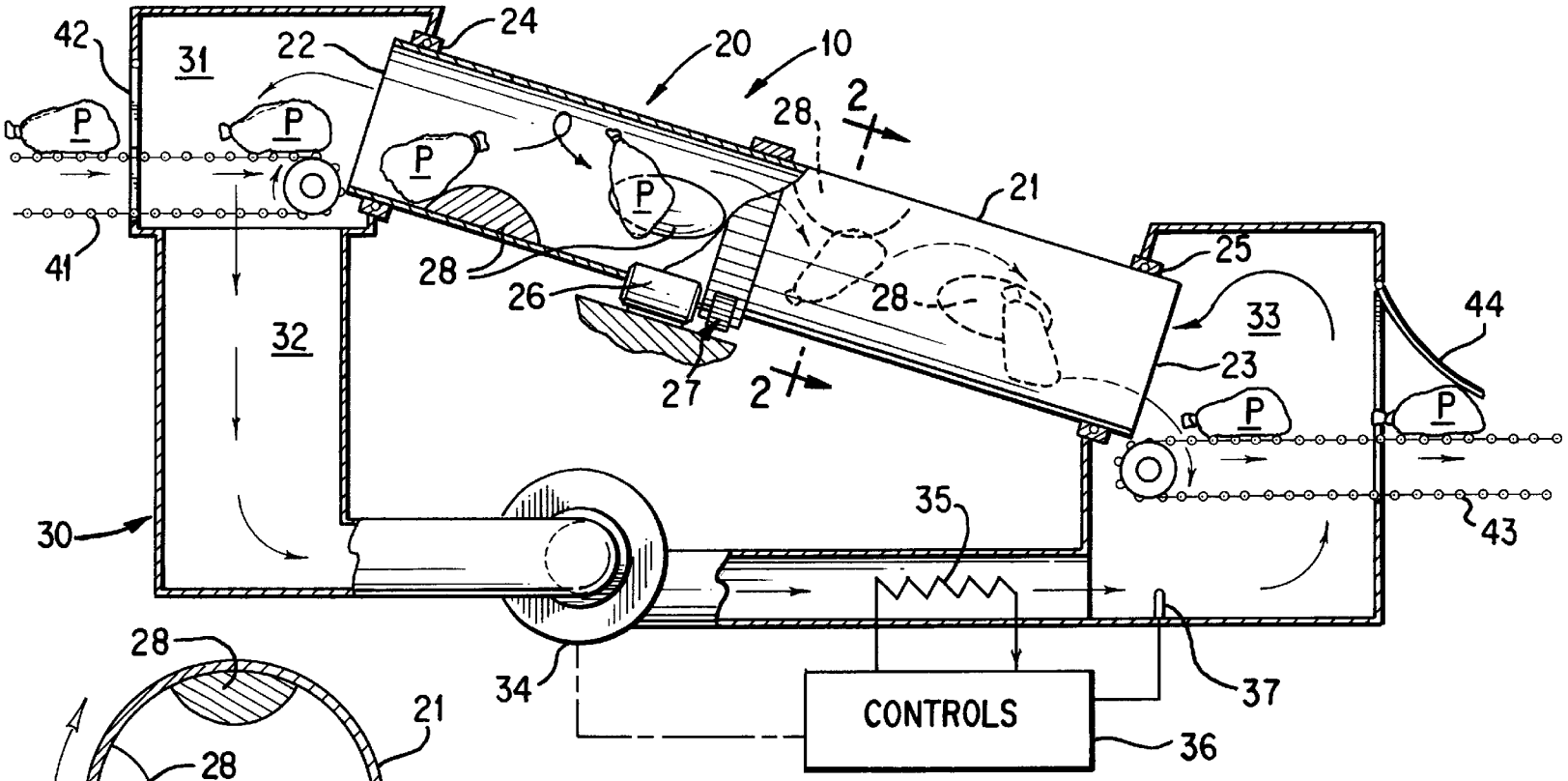
FIG. 1 is a side elevation view of an embodiment of the shrink tunnel of the present invention showing a partial cut-away of the tunnel.

Referring now to FIG. 1, the shrink tunnel system of the present invention is shown in its entirety at 10. The system has a tunnel section 20 having an inlet and outlet, and an enclosed circulating heat transfer medium section generally designated as 30. The enclosed circulating system 30 connects with the tunnel section 20 so that very little of the heated transfer medium is lost outside of the system.

As shown in the embodiment of FIG. 1, the tunnel section 20 comprises a rotating tunnel 21. The tunnel is inclined to the horizontal with one end being an inlet end 22 at a higher elevation than the other end being an outlet end 23 for gravity feed through the tunnel. The degree of incline of the rotating tunnel will depend upon a number of factors hereafter described, but it should be understood that the degree of incline may be made to be adjustable. The degree of incline is determined by the desired dwell time and may be varied but is normally about 5° to about 15°.

The tunnel is journaled with bearings or the like 24, 25 at the inlet end 22 and the outlet end 23 with the gas circulating system 30 to form a heat transfer medium circulating system which is basically closed to the atmosphere outside the system. The tunnel may be made of stainless steel, which has relatively good heat transfer properties. However, the interior surfaces may include a resilient liner such as by coating a high heat capacity and heat transfer material, for example, ethylene/propylene rubber, urethane or silicone with or without appropriate fillers to increase heat capacity. Alternatively, the line may comprise partially fluid filled resilient sacs containing a fluid that contributes to the heat capacity of the chamber wall. The heat transfer ability of the surfaces of the interior of the tunnel contacting the tumbling package coupled with the passing gas impart the heat needed to shrink the thermoplastic film.

Figure 2:
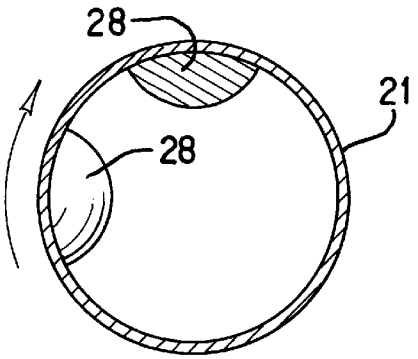
FIG. 2 is a cross-sectional view of the shrink tunnel of the present invention taken on line 2—2 of FIG. 1.

The rotating tunnel 21 is driven by a motor 26 through a gear drive 27 surrounding the tunnel. It should be understood that any suitable driving means may be used. The rotational speed of the tunnel will vary depending upon a number of factors including the temperature and velocity of the heated transfer medium, the dwell time desired for the wrapped package, the interior configuration of the tunnel and the physical characteristics of the thermoplastic film. Generally, the rotational speed of the tunnel is about 1–10 r.p.m. The rotating tunnel shown in FIG. 1 is cylindrical or in the shape of a tube and as shown in FIG. 2, is circular in cross-section.

An important aspect of this invention is that the product to be shrink wrapped is tumbled, i.e., physically turned and/or rotated during its passage through the shrink tunnel to achieve even heat transfer by contacting all the faces of the wrapped product with heated gas and the heated surfaces of the interior of the tunnel. Although the wrapped package will be turned to a degree simply by the rotation of the tunnel, it is desirable to provide means to promote additional turning and rotation of the package as the film is being shrunk. To this end, protrusions or other shaped members, not limited by number, size and shape, are provided in the tunnel interior to cause the package to turn and rotate as it passes through the tunnel. Exemplary protrusions 28 are shown in FIG. 1. The protrusions 28 project part way into the interior of the rotatable tunnel 21 as shown more clearly in FIG. 2. The protrusions 28 may be of rigid material formed as part of the tunnel itself or they may be of a resilient material affixed to the interior surface or a bag or pouch of resilient material and containing fluid such as a liquid silicone or water, and affixed to the interior surface of the tunnel. The deformability of the resilient material provided an increased heat transfer surface between the faces of packaged product and the heated interior surfaces. As indicated in FIG. 1, the shrink tunnel section 20 is in communication with an enclosed heat transfer medium circulating section 30. The wrapped package P to be shrunk is introduced to the inlet 22 of rotatable tunnel 21 via a conveyor belt 41 or the like where the package is passed into the rotatable tunnel. The package is carried on the conveyor 41 through curtained opening 42 into heat transfer medium return chamber 31 and then into the rotating tunnel 21. Upon leaving the rotating tunnel 21, the package P whose thermoplastic film has been shrunk is carried through heat transfer medium inlet chamber 33 on conveyor 43 through curtained exit 44. Although curtained entrance opening 42 and exit opening 44 do not form a perfectly closed circulating system, the amount of heat transfer medium loss is relatively small.

In a preferred embodiment of this invention, the heat transfer medium section 30 recirculates the medium, preferably air, in an enclosed system. Heated air passes through inlet plenum 33 in the direction of the arrows into the outlet end 23 of rotating tunnel 21. The thermoplastic wrapping on the product is shrunk by passage of the heated medium through the rotating tunnel where the interior surfaces of the tunnel and the faces of the package absorb heat. The cooler air exits the rotating tunnel into return chamber 31 where it is recirculated via return plenum 32 and is brought by a fan 34 through a heater 35 where it is heated to a predetermined temperature. The reheated air is again passed through inlet plenum 33 into the outlet end 23 the rotating tunnel.

In the return portion of gas circulating system 30 is a heater—in this case an electrical resistance heater, the power to which is controlled by control device 36 which is also connected to a temperature-sensor 37 in the return circuit, but downstream of the heater. The heated air transfers heat energy to the wrapped package and the interior walls of the rotating tunnel. The air leaving the tunnel remains, however, warmer than ambient air. Therefore, by using the recirculating system of this invention, considerable savings in energy costs are obtained over using either an open air system or a hot water system.

Figure 6:
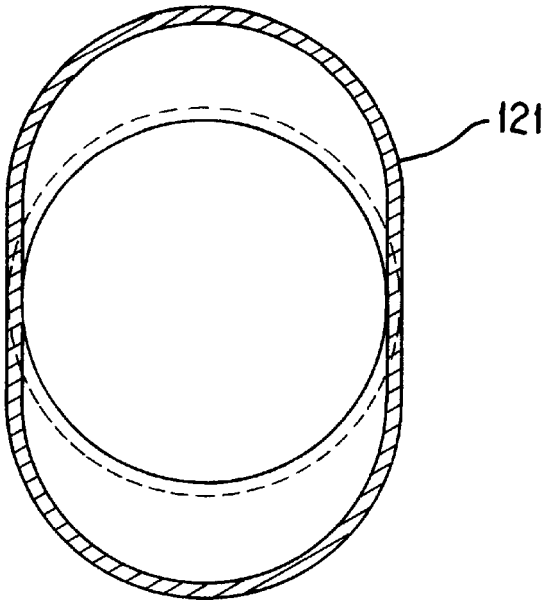
FIG. 6 is a cross-section view of an embodiment of the shrink tunnel taken along line 6—6 of FIG. 5 illustrating an oval shape of a portion of the tunnel.
Figure 7:
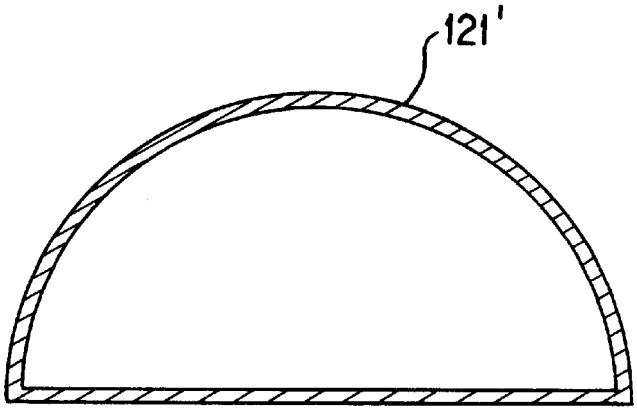
FIG. 7 illustrates an alternative cross-section shape of the tunnel.
Figure 8:
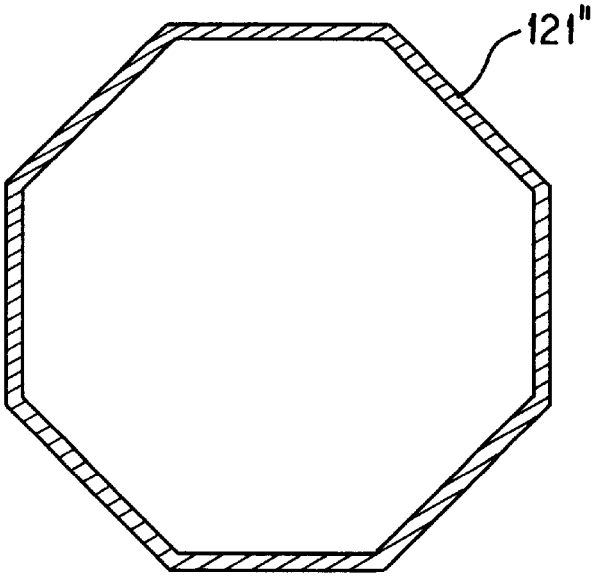
FIG. 8 illustrates another cross-sectional shape of the tunnel.

As previously discussed, an important aspect of this invention is the ability to improve the heat transfer in the tunnel by increasing the amount of surface contact between the faces of the wrapped product and the interior surfaces of the tunnel. An additional means to increase the heat transfer is to design the interior shape of the tunnel surfaces to increase the surface contact. One means for increasing the surface-to-surface contact is to use cross-sectional shapes other than circular, such as oval, square, octangular or frustoconical to obtain a similar effect in tumbling the package and enhanced heat transfer. There is shown in FIG. 5 an alternative embodiment of the heat shrink tunnel section 120 comprising a rotating tunnel 121. Rotating tunnel 121 is journaled with bearings or the like 124, 125 at the inlet end 122 and the outlet end 123. The tunnel may be rotated by any convenient means such as motor 126 and gear drive 127. The package P to be shrunk is carried on conveyor 141 through curtained opening 142 into heat transfer medium return chamber 131 and then into the rotating tunnel 121 through inlet end 122. Upon leaving the rotating tunnel 121, the package P whose thermoplastic film has been shrunk is carried through product outlet end 123 into heat transfer medium inlet chamber 133 and onto conveyor 143 exiting through curtained exit 144. The tunnel of this embodiment may be used with a recirculating heat transfer system such as shown in FIG. 1. The cross-section of the tunnel is designed to provide increased surface contact with the packaged product. One such cross-sectional shape is the oval shape of a portion of the tunnel shown in FIG. 6. Other cross-sectional shapes include the semi-circular shape shown in FIG. 7 and the octangular cross-sectional shape shown in FIG. 8.

In a preferred operation, a package containing a food product wrapped in thermoplastic material is conveyed to the inlet end of the rotating tunnel. As the wrapped food product tumbles through the tunnel, it rolls down over the protrusions rotating and turning as it is passed by gravity to the outlet end. As the product passes through the tunnel, the film is heated to a temperature sufficient to impart the heat shrinking of the film about the product. The temperature of the food product in the package should not be allowed to rise above the temperature at which the product degrades or discolors. The temperature must be above the shrink initiation temperature of the film. While this temperature will vary from film to film, it typically begins at 160° F. and the rate increases as a function of time. To attain the proper film shrink temperature, the circulating air is heated, for example, to between about 250° F. and 300° F. With these factors in place, the speed of rotation and incline of the tunnel are controlled to effectively shrink the wrapper around the product as it passed through the tunnel and exits the outlet end.

The enhanced efficiency of shrinkage using a heated gas such as air, rather than much higher thermal capacity media such as water, is due to the increased surface-to-surface contact of the faces of the package and the interior surfaces of the tunnel, and the relatively high mass flow rates of air available with a return flow shrink tunnel. Also, the conservation of heat is enhanced by both thermally insulating the tunnel walls and ensuring that air from the tunnel section is returned over the heater to replenish the heat quantity carried by the air before it next contacts a package P.

Since many variations, modifications and changes in detail may be made to the embodiment described in the foregoing description and shown in the accompanying drawings without departure from the scope and spirit of the invention, the description of the drawings shall be interpreted as illustrative and not in a limiting sense.

For example, although the preferred embodiment includes gravity feed of the package through the tunnel, alternative means could include conveyors such as an interior helix similar to an Archimedes screw which can transport a package horizontally, or upwards through the tunnel. In either embodiment, the heated medium may flow either opposite the direction of the package or in the same direction as the package.

What is claimed is:

1. An apparatus for heat shrinking a flexible thermoplastic film that packages a fresh meat product comprising:

(a) a tunnel capable of being rotated and being inclined to the horizontal with one end being an inlet end at a higher elevation than the other end being an outlet end for gravity feeding a packaged fresh meat product through the tunnel;

(b) means for rotating said tunnel;

(c) means communicating with said inlet end and said outlet end for passing a gaseous heat transfer medium through said tunnel;

(d) means for heating said gaseous transfer medium; and (e) means for controlling the temperature and velocity of said gaseous transfer medium through said tunnel; and (f) a plurality of deformable fluid containing closed bags affixed to interior surfaces of the tunnel, whereby the surfaces of the packaged fresh meat product passing through the tunnel contact the bags and are caused to tumble.

2. A method for heat shrinking a thermoplastic film that has been used to package a fresh meat product comprising:

(a) moving a packaged fresh meat product into a rotatable shrink tunnel, said tunnel being inclined to the horizontal with one end being an inlet end at a higher elevation than the other end being an outlet end for gravity feeding the packaged fresh meat product through the tunnel;

(b) passing a heated gaseous heat transfer medium through said shrink tunnel whereby the interior surface of said shrink tunnel is heated while rotating said tunnel;

(c) moving the packaged fresh meat product by gravity through said heated tunnel while said tunnel is rotating whereby heat from said gas and heat from the interior surfaces of said shrink tunnel are imparted to the packaged fresh meat product causing the film to shrink; and (d) removing said packaged fresh meat product from the tunnel.

3. The method according to claim 2 wherein said gaseous transfer medium is air.

4. The method according to claim 2 further comprising recirculating and reheating said gaseous heat transfer medium.

* * * * *